US009078315B2

(12) United States Patent
Pantano et al.

(10) Patent No.: US 9,078,315 B2
(45) Date of Patent: Jul. 7, 2015

(54) CURRENT DRIVER FOR AN ARRAY OF LED DIODES

(71) Applicant: STMicroelectronics S.r.l., Agrate Brianza (IT)

(72) Inventors: Salvatore Pantano, Pedara (IT); Marco Martini, Acireale (IT)

(73) Assignee: STMicroelectronics S.r.l., Agrate Brianza (MB) (IT)

( * ) Notice: Subject to any disclaimer, the term of this patent is extended or adjusted under 35 U.S.C. 154(b) by 0 days.

(21) Appl. No.: 14/154,573

(22) Filed: Jan. 14, 2014

(65) Prior Publication Data

US 2014/0197752 A1 Jul. 17, 2014

(30) Foreign Application Priority Data

Jan. 17, 2013 (IT) ..... MI2013A0061

(51) Int. Cl.
*H05B 33/08* (2006.01)

(52) U.S. Cl.
CPC ..... *H05B 33/0815* (2013.01); *H05B 33/0827* (2013.01); *H05B 33/0848* (2013.01)

(58) Field of Classification Search
None
See application file for complete search history.

(56) References Cited

U.S. PATENT DOCUMENTS 7,633,233 B2 * 12/2009 Sanchez ..... 315/169.3
7,830,095 B2 * 11/2010 Erhardt ..... 315/224
7,902,771 B2 * 3/2011 Shteynberg et al. ..... 315/307
8,093,825 B1 * 1/2012 Van Ess et al. ..... 315/291
8,284,126 B2 * 10/2012 Kwon ..... 345/76
8,289,263 B2 * 10/2012 Lee et al. ..... 345/102
2007/0195025 A1 8/2007 Korcharz et al.
2012/0062192 A1 3/2012 Okuma

FOREIGN PATENT DOCUMENTS

WO WO-2008110990 A1 9/2008

OTHER PUBLICATIONS

Italian Search Report and Written Opinion for IT MI2013A000061 mailed Sep. 23, 2013 (8 pages).
Microchip: "LED Lighting Design Guide," LED Lighting Solutions, Sep. 23, 2010, pp. 12-13, XP002713432.

* cited by examiner

*Primary Examiner* — Jason M Crawford
*Assistant Examiner* — Nelson Correa
(74) *Attorney, Agent, or Firm* — Gardere Wynne Sewell LLP

(57) ABSTRACT

An array of LED diodes includes N channels each having LEDs coupled in series with a switch. A current driver for the array includes a processing circuit configured to detect N currents flowing respectively through the N channels of the array. The detected currents are converted by a single analog to digital converter, one at a time, into a digital word. The circuit further includes N comparator devices configured to control the N switches as result of a comparison between the digital words and respective target digital words. A memory is provided for storing the digital words received from the analog to digital converter.

13 Claims, 5 Drawing Sheets

CURRENT DRIVER FOR AN ARRAY OF LED DIODES

PRIORITY CLAIM

This application claims priority from Italian Application for Patent No. MI2013A000061 filed Jan. 17, 2013, the disclosure of which is incorporated by reference.

TECHNICAL FIELD

The present disclosure relates to a current driver for an array of LED diodes.

BACKGROUND

The use of LED diodes in applications like displays, information and advertising panels, signs, traffic signals, automotive lighting is becoming more and more common and sophisticated.

A current driver device for LED diodes has to provide very high and accurate channel currents. The current accuracy of all the channels is of course the main common feature of all current driver devices, however, the modern LED array drivers are offering a large amount of extra features.

A typical LED array is constituted of a plurality of channels providing the output current required to turn on the LED diodes. A current driver for the LED array comprises a voltage reference, which usually is a buffered band-gap voltage. An external resistance is connected between the voltage reference and a ground reference GND, in order to generate a current used internally as an accurate current reference.

FIG. 1 shows a basic implementation of a current driver for LED diodes applied to a channel of the LED array. The reference current $I_{ref}$ flows through a resistance $R_{ref}$ generating a voltage drop $V_{ref}$. An output current $I_{out}$ flows through a series of LED diodes, connected between a voltage $V_{led}$ and a first terminal of a switch M1 (for example a MOSFET device). A resistance $R_{sense}$ is connected between a second terminal of the switch M1 and a ground reference GND, and a voltage $V_{sense}$ is generated by the flow of current $I_{out}$ through it. The switch M1 is driven by the output signal of an operational amplifier OPAMP configured to make the voltage $V_{sense}$ (at the inverting terminal) equal to the voltage reference Vref (at the non-inverting terminal). The current $I_{ref}$ is mirrored to all the channels of the array.

The accuracy between different channels is affected by numerous parameters, for example the mismatch of current mirrors, the offset voltage of the operational amplifier OPAMP, the mismatch of resistances $R_{ref}$ and $R_{sense}$ or the mismatch of the GND metal affecting the voltage $V_{sense}$. The chip to chip precisions, instead, are affected mainly by the band gap voltage reference $V_{ref}$ and the current mirror accuracy.

Currently the current driver for an array of LED diodes uses digital circuits in each channel for modulating the current flowing through the channel; this determines a large area of circuit consumption and reduced cost effectiveness.

SUMMARY

One aspect of the present disclosure is to provide a current driver for an array of LED diodes with very accurate output channel currents and a lower area consumption.

One aspect of the present disclosure is a current driver for an array of LED diodes, the array including N channels each one comprising a plurality of LED diodes and a switch arranged in the electric path between the plurality of LED diodes and a common voltage reference, the current driver comprising: a processing circuit configured to detect N currents flowing respectively through the N channels of said array of LED diodes and convert each detected current into a digital word, N comparator devices configured to control said N switches as result of a comparison between said digital words and the target digital words, wherein said processing circuit comprises one analog to digital converter configured to convert one at the time the N detected currents into said digital words, said processing circuit also comprising a memory for storing said digital words received from the analog to digital converter.

BRIEF DESCRIPTION OF THE DRAWINGS

For a better understanding of the present invention, a preferred embodiment thereof is now described, purely by way of non-limiting example and with reference to the annexed drawings, wherein.

DETAILED DESCRIPTION OF THE DRAWINGS

Figure 1:
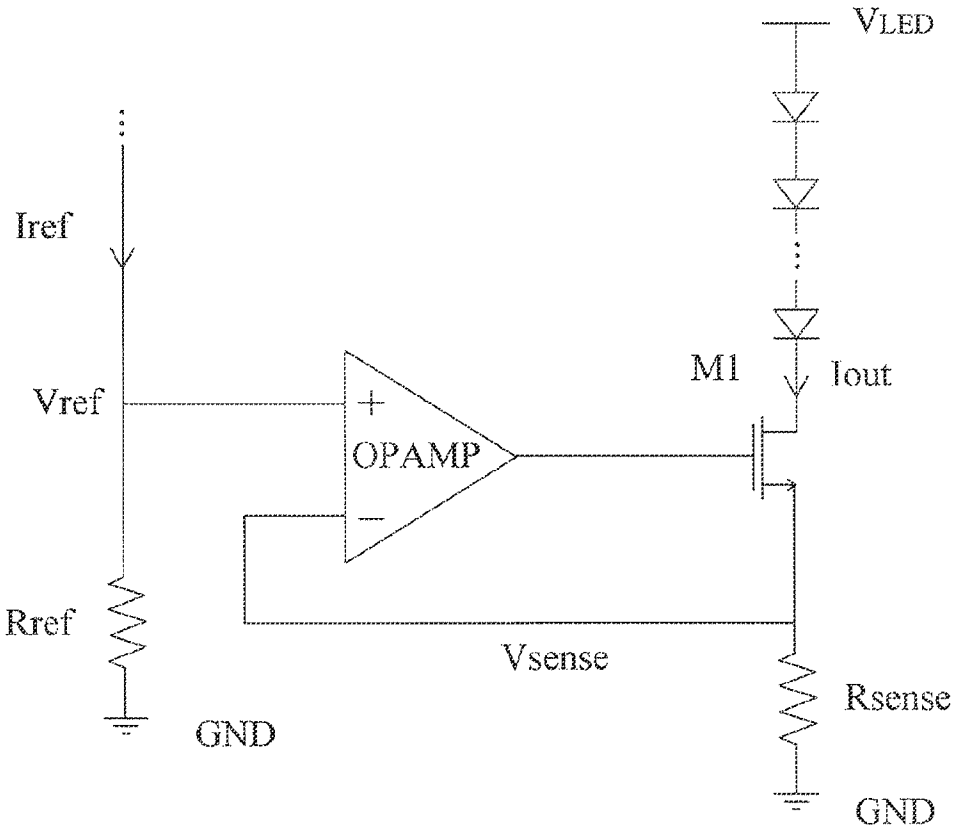
FIG.1 (PRIOR ART)
FIG. 1 shows a current driver for an array of LED diodes according to the prior art.
Figure 2:
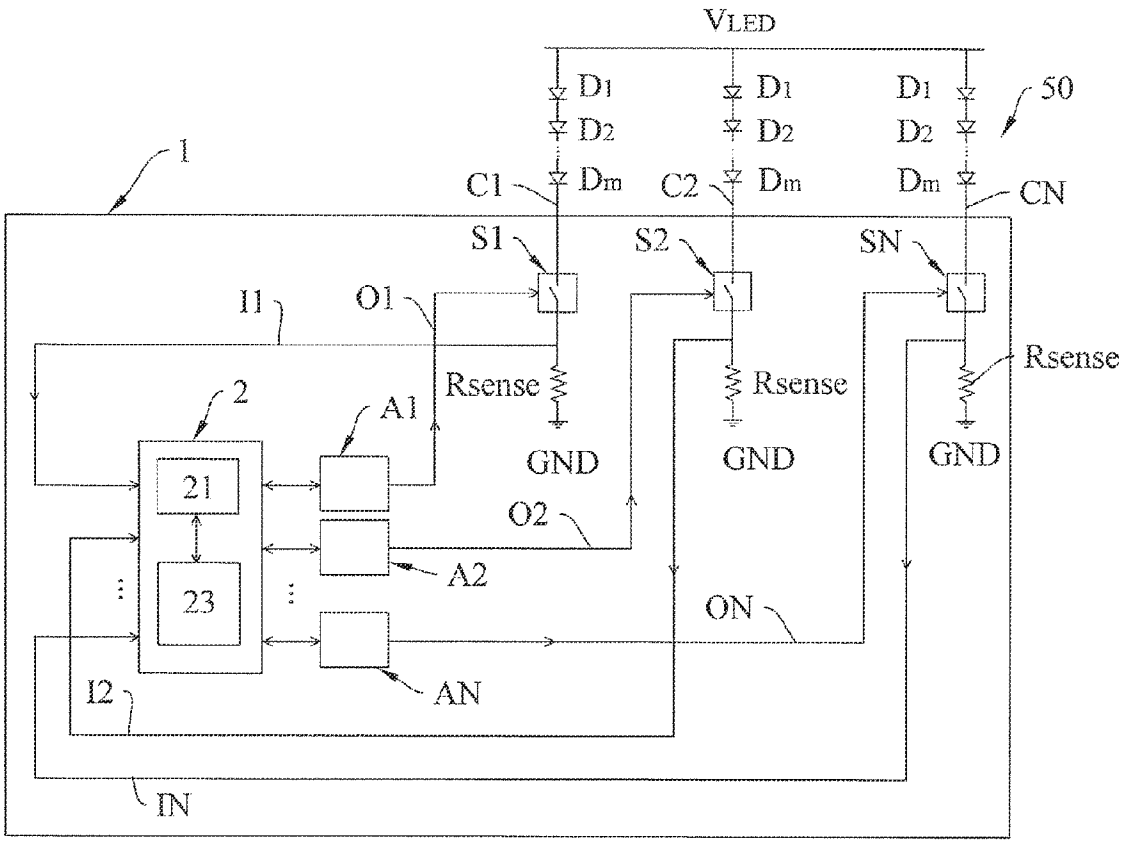
FIG. 2 shows a block diagram of a current driver for an array of LED diodes according to the present disclosure.

A current driver 1 for an array 50 of LED diodes according to the present disclosure is shown in FIG. 2. The array 50 comprises N channels C1, C2, . . . CN, (where N is an integer number), each one coupled to a supply voltage $V_{LED}$ and each one comprising a plurality of LED diodes D1 . . . Dm, and N switches S1, S2, . . . SN arranged in an electric path between each plurality of LED diodes and a common voltage reference GND; for example, the array 50 has N=16 current channels. A resistance $R_{sense}$, coupled between the plurality of LED diodes and the common voltage reference GND, is provided in each channel Ci (i=1, 2, . . . N) to detect the current of the channel Ci (i=1, 2, . . . N) itself.

The current driver 1 comprises a processing circuit 2 configured to detect N currents I1, I2, . . . IN flowing through the channels C1, C2, . . . CN by means of the resistances $R_{sense}$, convert into a digital word Wi (i=1, 2, . . . N) each detected current Ii (i=1, 2, . . . N), one at a time, and store said obtained digital words. For example, each digital word Wi (i=1, 2, . . . N) is a word of 12 bit.

The current driver 1 further comprises a plurality of comparator devices A1, A2, . . . AN each one coupled to each one of the switches S1, S2, . . . SN; each comparator device A1, A2, . . . AN is configured to control the respective switch Si (i=1, 2, . . . N) by its output digital signal Oi (i=1, 2, . . . N) as result of a comparison between the digital word Wi (i=1, 2, . . . N) representing the current flowing through the given channel Ci (i=1, 2, . . . N) and a target digital word Ti (i=1, 2, . . . N) representing a desired current value for said given channel Ci (i=1, 2, . . . N).

Figure 3:
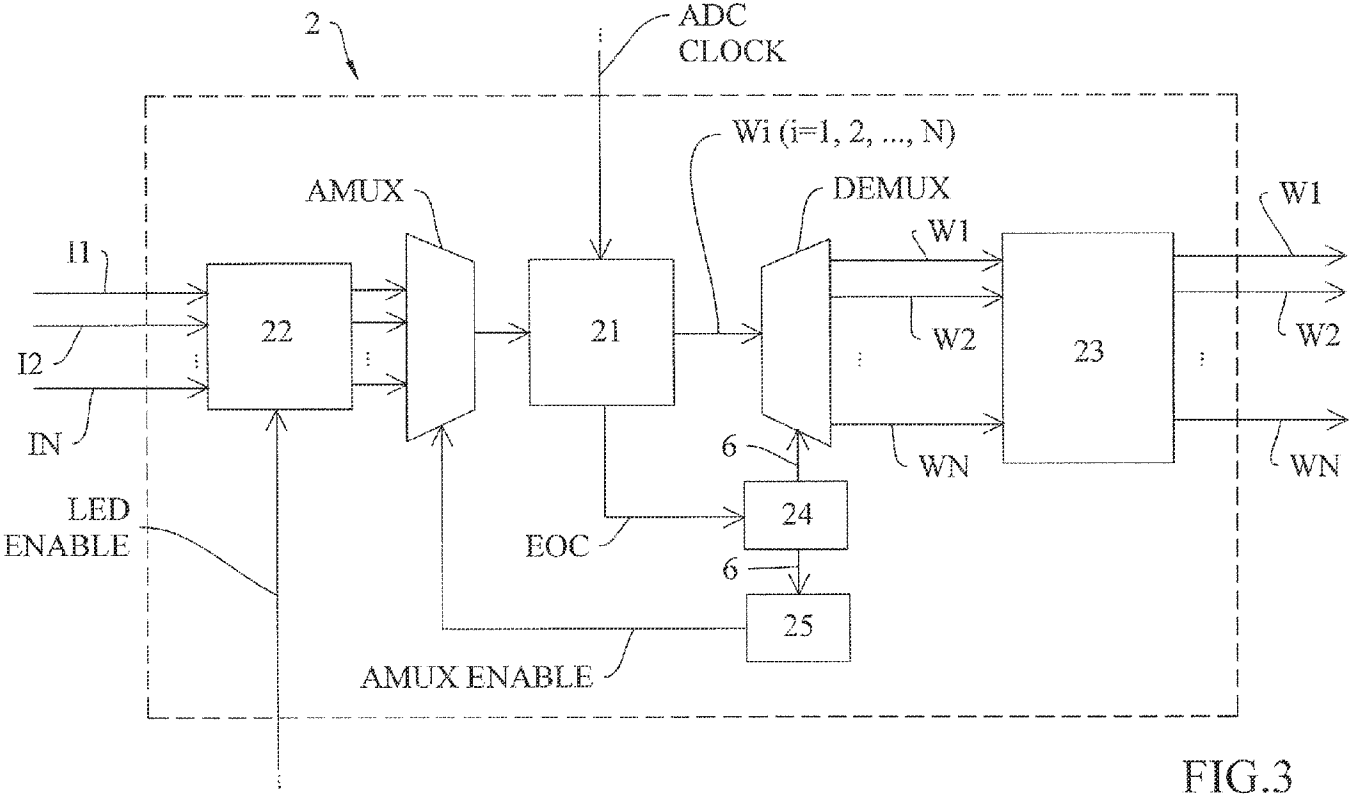
FIG. 3 shows a block diagram of a processing circuit of the current driver of FIG. 2.

The processing circuit 2 (shown in more detail FIG. 3) comprises a sample and hold or S/H circuit 22 configured to sample, preferably at the same time, the currents detected in the channels C1, C2, . . . , CN, a multiplexer AMUX configured for receiving said N sampled currents and selecting one of them at a time. The multiplexer AMUX is driven by a selecting signal AMUX ENABLE. The S/H circuit 22 is enabled and disenabled by a status signal LED ENABLE indicating if the LED diodes of the array 50 are on or off; the signal LED ENABLE is external to the current driver. For example, the status signal LED ENABLE is a single bit signal.

The processing circuit 2 comprises an analog to digital converter or ADC 21 configured to perform one at a time the conversion of the 16 selected sampled currents into said 16 digital words W1, W2, . . . WN. The process circuit 2 also comprises a memory 23 for storing the digital words W1, W2, . . . WN received from the analog to digital converter 21. Preferably the memory 23 comprises N memory banks each one suitable for the storing one of the digital words W1, W2, . . . WN.

The processing circuit 2 comprises also a demultiplexer DEMUX configured to address towards the memory 23, that is towards one of the N banks of the memory 23, the digital word Wi (i=1, 2, . . . N) received one at a time from the analog to digital converter 21. Moreover the processing circuit comprises a counter 24 configured to provide a driving signal 6, for example at 4 bits, to the demultiplexer DEMUX and, through a thermometric encoder 25, the selecting signal AMUX ENABLE, for example at 16 bit, to the multiplexer AMUX.

The counter 24 counts from 0 to 15 to effect a continuous measurement sequence on all the channels C1, C2, . . . CN of the array 50, that is, the counter 24 allows that each sampled current relative to the channels C1, C2, . . . CN is converted into a digital word.

The analog to digital converter 21 is synchronized by an internal oscillator and it is configured to send an end-of-conversion signal EOC to the counter 24 to indicate the end of the conversion process. For example, the signal EOC is a single bit signal.

The thermometric encoder 25 is configured for encoding the driving signal 6 at 4 bits received from the first counter 24 into said 16 bit selecting signal AMUX ENABLE provided to the multiplexer AMUX.

Figure 4:
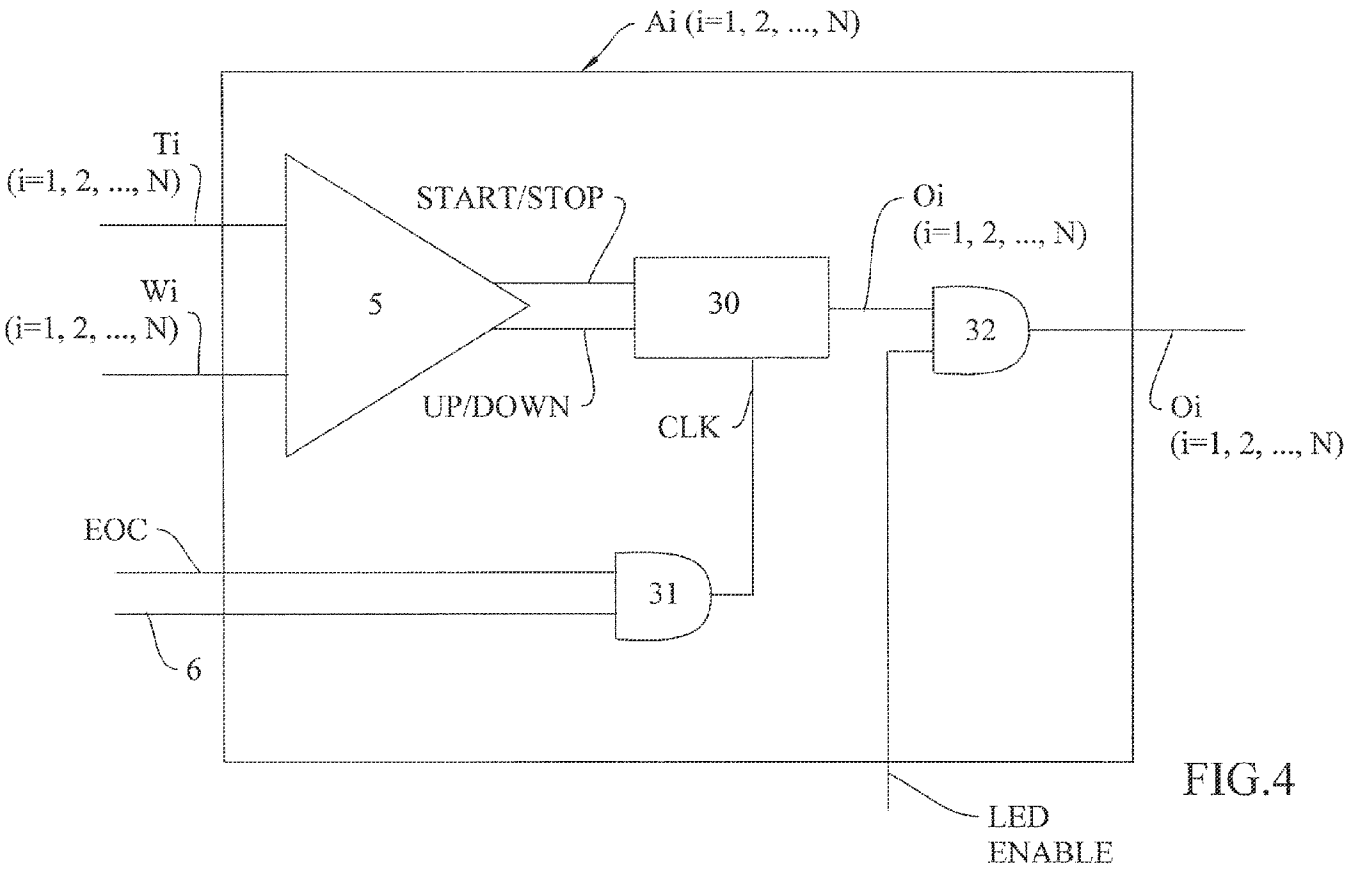
FIG. 4 shows a block diagram of a comparator device of the current driver of FIG. 2.

Each of the comparator devices A1, A2, . . . AN (shown in more detail in FIG. 4) comprises an hysteresis comparator 5 configured to provide a first UP/DOWN and a second START/STOP internal signals to a second counter 30 as a function of the comparison between one digital word Wi (i=1, 2, . . . N) representing a given current channel value and stored in the memory 23 and the respective target digital word Ti (i=1, 2, . . . N) representing the desired current value for said given channel Ci (i=1, 2, . . . N). Preferably, the target digital words Ti (i=1, 2, . . . N) could be stored in a further memory and rewritable trough an user interface, for example a I2C interface.

Each of the comparators 5 receives the digital word Wi (i=1, 2, . . . N) at a first input terminal and the target digital word Ti (i=1, 2, . . . N) at a second input terminal and carries out a comparison between them. The first internal signal UP/DOWN is provided to the second counter 30 to perform an up counting process or a down counting process respectively if the digital word Wi (i=1, 2, . . . N) is lesser or greater than the target digital word Ti (i=1, 2, . . . N). The second internal signal START/STOP is also provided to the second counter 30 to start the count if the digital word Wi (i=1, 2, . . . N) is lesser or greater than the target digital word Ti (i=1, 2, . . . N) or to stop the count if the digital word Wi (i=1, 2, . . . N) is equal to the target digital word Ti (i=1, 2, . . . N).

Said counter 30 is synchronized with a clock signal CLK which is the result of a digital AND operation between the end-of-conversion signal EOC and the driving signal 6 received from the counter 24 which is carried out by an AND device 31. An AND logic gate 32 is cascaded to said counter 30 and is configured for outputting the output digital signal Oi (i=1, 2, . . . N) if enabled by the signal LED ENABLE. The AND operation between the end-of-conversion signal EOC and the driving signal 6 allows outputting the output digital signal Oi (i=1, 2, . . . N) only when the i-th sampled current is selected and when the conversion process relative to the i-th sampled current is ended.

Figure 5:
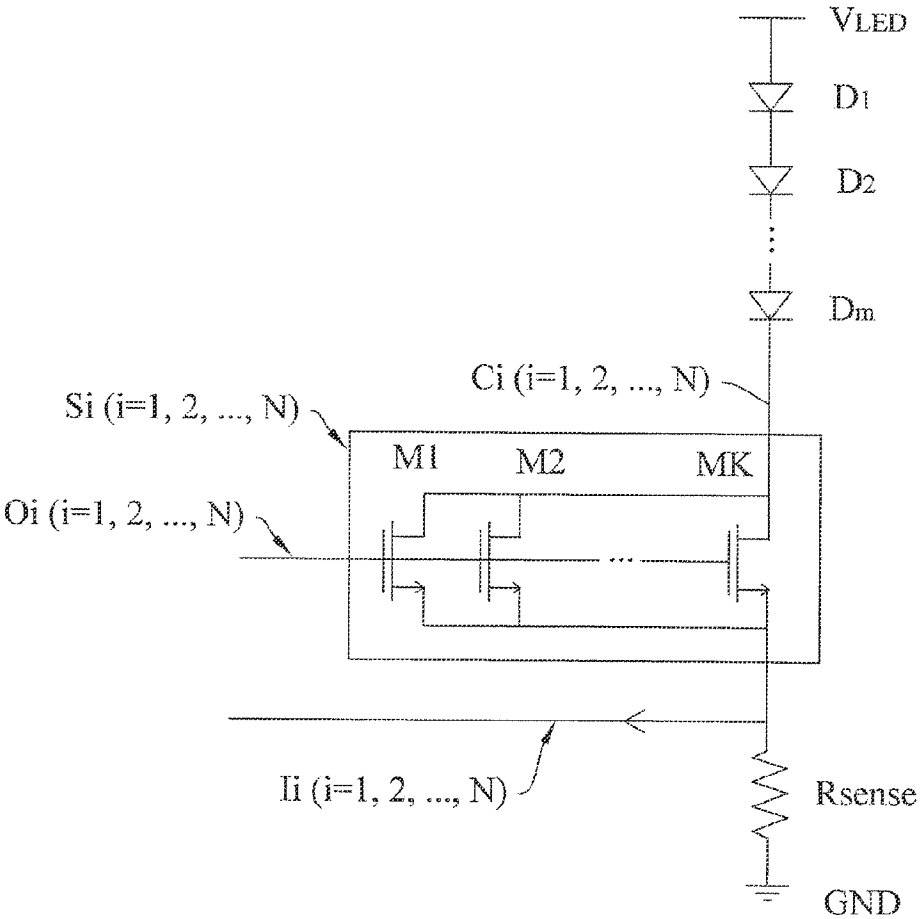
FIG. 5 shows a block diagram of a switch of the current driver of FIG. 2.

Each switch Si (i=1, 2, . . . N) (shown in more detail in FIG. 5) comprises a plurality of transistors M1, M2, . . . MK (where K is an integer number and, in this case, K=12), preferably MOS transistors, arranged in parallel to each other and driven by the output digital signal of the counter 30; said transistors M1, M2, . . . MK allows converting the digital signal Oi into a variable resistance inserted in series to the plurality of LED diodes of the channel for controlling the current flowing through said plurality of LED diodes. Each of said transistors M1, M2, . . . MK is configured to receive at the own control terminal one of the 12 bits of said output digital signal Oi (i=1, 2, . . . N) received from each counter 30. Each one of said transistors M1, M2, . . . MK is configured for being opened (that is turned off) or closed (that is turned on) by the bit value of the output digital signal Oi (i=1, 2, . . . N). Each one of these MOS transistors M1, M2, . . . MK when closed (ON state) have a resistance value equal to Rfix/2^(K−1); in this way, by opening or closing it, the equivalent resistance of the path through the Si block is modified (increased or reduced respectively) and this implies a modification of the current through the channel Ci (i=1, 2, . . . N). Therefore the transistors M1, M2, . . . MK allows modulating the channel current value in response to the comparison between the digital word Wi and the target digital word Ti, that is the increase or decrease of the channel current value respectively if the digital word Wi is lesser or greater than the target digital word Ti. The transistors M1, M2, . . . MK have same length and different width: for example, the transistors M1, M2, . . . MK are NMOS transistor with a width of $2^{m-1}/W_{min}$ (m=1, 2, . . . K) where $W_{min}$ is the width of the smallest transistor; in this way each one of the K bit of the digital signal Oi (i=1, 2, . . . N) has a different weight on the modulation of the current flow of each channel Ci (i=1, 2, . . . N).

An implementation of the current driver 1 for an array 50 comprising N=16 channel according to the present disclosure operates as follows.

The S/H 22 receives and samples the 16 currents I2, I2, . . . I16 flowing through the channels C1, C2, CN, as a function of the status signal LED ENABLE indicating if the LED diodes of the array 50 are on or off.

The counter 24 manages the selection of one of the 16 sampled currents at a time, by sending the selecting signal AMUX ENABLE to the multiplexer AMUX. The given current Ii (i=1, 2, . . . N) is converted in a 12 bit digital word Wi (i=1, 2, . . . N) by means of the analog to digital converter 21. After each conversion, the analog to digital converter 21 generates the end-of-conversion signal EOC to indicate the end of the conversion. Said end-of-conversion signal EOC is received by the counter 24 and interpreted as a starting signal for a new conversion process. The counter 24 progressively increments the count from 0 to 15, sending the driving signal 6 to the multiplexer AMUX, through the thermometric encoder 25 that receives the driving signal 6 and sends to the multiplexer AMUX the signal AMUX ENABLE, so to allow the selection of all the channel currents I1, I2, . . . IN. The thermometric encoder 25 operates as shown in the following table:

| DRIVING SIGNAL 6 | AMUX ENABLE |
|---|---|
| 0000 | 0000000000000001 |
| 0001 | 0000000000000010 |
| 0010 | 0000000000000100 |
| 0011 | 0000000000001000 |
| 0100 | 0000000000010000 |
| 0101 | 0000000000100000 |
| 0110 | 0000000001000000 |
| 0111 | 0000000010000000 |
| 1000 | 0000000100000000 |
| 1001 | 0000001000000000 |
| 1010 | 0000010000000000 |
| 1011 | 0000100000000000 |
| 1100 | 0001000000000000 |
| 1101 | 0010000000000000 |
| 1110 | 0100000000000000 |
| 1111 | 1000000000000000 |

The 12 bit digital word Wi (i=1, 2, . . . N) representing the digital value of the given channel current Ii (i=1, 2, . . . N) is addressed by means of a demultiplexer DEMUX towards the memory 23 for the storage said digital word in one of the 16 memory banks. The counter 24 provides to the demultiplexer DEMUX the driving signal 6, allowing the selection of the given digital word Wi (i=1, 2, . . . N) to be addressed. Each digital word Wi (i=1, 2, . . . N) is address in the respective memory bank.

After the acquisition of all the 16 channel currents I1, I2, . . . IN, each of the 16 digital word stored in the memory 23 are compared by 16 comparators 5 with 16 target digital words Ti (i=1, 2, . . . N), representing the desired current value in each channel Ci (i=1, 2, . . . N).

Each one of the comparators 5 provides the first UP/DOWN and the second START/STOP internal signals according to the counter 30 to perform an up count or a down count respectively if the digital word Wi (i=1, 2, . . . N) is lesser or greater than the target digital word Ti (i=1, 2, . . . N). The second internal signal START/STOP is also provided to the counter 30 to start the count if the digital word Wi (i=1, 2, . . . N) is less or greater than the target digital word Ti (i=1, 2, . . . N) or to stop the count if the digital word Wi (i=1, 2, . . . N) is equal to the target digital word Ti (i=1, 2, . . . N).

In this way the counter 30 for each channel of the array 50 provides the respective output digital word Oi (i=1, 2, . . . N). The status signal LED ENABLE then allows the transfer of the output digital word Oi (i=1, 2, . . . N) to the control terminal of each one of the switches Si (i=1, 2, . . . N) so as to modify (increasing or decreasing) the value of the channel current Ii (i=1, 2, . . . N) until the value of the current Ii (i=1, 2, . . . N) is the one desired, that is until Wi=Ti.

Each one of the 12 transistors M1, M2, . . . MK comprised in each switch Si (i=1, 2, . . . N) is opened or closed by one of the 12 bits B1, B2, . . . BK of the output digital signal Oi (i=1, 2, . . . N) so to regulate the current flux through each channel Ci (i=1, 2, . . . N).

What is claimed is:

1. A current driver device for an array of LED diodes, the array including N channels each one comprising a plurality of LED diodes and a switch arranged in the electric path between the plurality of LED diodes and a common voltage reference, the current driver comprising:

a processing circuit configured to detect N currents flowing respectively through the N channels of said array of LED diodes and convert each detected current into a digital word, N comparator devices configured to control said N switches as result of a comparison between said digital words and respective target digital words, wherein said processing circuit comprises one analog to digital converter configured to convert one at a time the N detected currents into said digital words, and wherein said processing circuit further comprises a memory configured to store said digital words received from the analog to digital converter;

wherein each of said comparator devices comprises:

a first counter, and a comparator configured to compare one digital word stored in the memory and the respective target digital word, said comparator configured to set an up counting or a down counting process of the first counter if respectively the digital word is lesser or greater than the respective target digital word and to stop the counting process of the first counter if the digital word is equal to the respective target digital word, the output digital signal of the second counter controlling the respective switch of the respective channel of the array for increasing or decreasing the channel current value respectively if the digital word is lesser or greater than the target digital word.

2. The current driver according to claim 1, wherein said processing circuit further comprises:

a multiplexer configured to send each of the N detected currents, one at the time, to the analog to digital converter, and a second counter configured to set the multiplexer to send all the N detected currents, one at the time, to the analog to digital converter.

3. The current driver according to claim 2, wherein said memory comprises at least N banks each configured to store one of the digital words and wherein said processing circuit further comprises:

a demultiplexer configured to send to said memory the digital words received from the analog to digital converter, said second counter configured to set the demultiplexer to address each digital word received from the analog to digital converter towards the respective bank of the memory.

4. The current driver according to claim 2, wherein the analog to digital converter is configured to send an end-of-conversion signal to the first counter as a starting signal for the count of second counter.

5. The current driver according to claim 2, wherein said first counter is synchronized with a clock signal, which is the result of a digital AND operation between the end-of-conversion signal deriving from the analog to digital converter and a driving signal deriving from said second counter.

6. The current driver according to claim 1, wherein each one of said switches comprises K transistors arranged in parallel, said first counter being configured to output a digital signal of at least K bits for driving the switch so that each one of the K transistors is respectively driven by at least one bit of said digital signal.

7. The current driver according to claim 6, wherein said transistors are configured to have same length and different width, so that each one of the K bit of said digital signal has a different weight on the modulation of the current flow of each channel.

8. The current driver according to claim 6, wherein said first counter is configured for outputting said digital signal if enabled by a status signal indicating the on or off state of the LED diodes of the array.

9. The current driver according to claim 1, wherein said comparator is an hysteresis comparator.

10. The current driver according to claims 1, wherein said processing circuit comprises a sample and hold circuit configured to sample all the N detected currents and to send each one of the sampled currents, one at the time, to the analog to digital converter, said sample and hold circuit being enabled to provide the sampled currents to the analog to digital converter if enabled by a status signal indicating the on or off state of the LED diodes of the array.

11. The current driver of claim 1, wherein each digitally controlled switch variable resistance circuit comprises a plurality of parallel-connected drive transistors coupled in series with the channel of LED diodes and a output of the comparator device operating to selectively actuate the drive transistors in order to vary a resistance of the digitally controlled switch variable resistance circuit.

12. A current driving method for an array of LED diodes, the array including N channels each one comprising a plurality of LED diodes and a digitally controlled switch variable resistance circuit arranged in the electric path between the plurality of LED diodes and a common voltage reference, the method comprising:

detecting N currents flowing through the N current channels of said array, converting one at a time the N detected currents into digital words, storing said digital words, comparing each stored digital word with a respective target digital word, and controlling the N digitally controlled switch variable resistance circuits in response to the comparison between said digital words and respective target digital words;

wherein comparing comprises:

setting an up counting or a down counting process if respectively the digital word is lesser or greater than the respective target digital word; and stopping the counting process if the digital word is equal to the respective target digital word; and wherein controlling comprises:

controlling the respective switch of the respective channel of the array for increasing or decreasing the channel current value respectively if the digital word is lesser or greater than the target digital word.

13. The method of claim 12, wherein each digitally controlled switch variable resistance circuit comprises a plurality of parallel-connected drive transistors coupled in series with the channel of LED diodes, and wherein controlling comprises selectively actuating the drive transistors in order to vary a resistance of the digitally controlled switch variable resistance circuit.

* * * * *